United States Patent [19]

Fogel

[11] 4,077,074

[45] Mar. 7, 1978

[54] WATERBED FRAME CONSTRUCTION

[76] Inventor: Isaac Fogel, 2428 Eastgate Rd., Silver Spring, Md. 20906

[21] Appl. No.: 742,620

[22] Filed: Nov. 17, 1976

[51] Int. Cl.[2] ..... A47C 27/08

[52] U.S. Cl. ..... 5/370

[58] Field of Search ..... 5/288, 289, 290, 293, 5/295, 296, 298, 299, 303, 366, 367, 370, 365, 371; 248/188, 188.1

[56] References Cited

U.S. PATENT DOCUMENTS

| | | | |
|---|---|---|---|
| 352,328 | 11/1886 | Kaufhold | 248/188 |
| 359,457 | 3/1887 | Mitchell | 248/188 |
| 863,650 | 8/1907 | Rockwell | 5/303 |
| 3,736,605 | 6/1973 | Klein, Jr. | 5/367 |

*Primary Examiner*—Peter M. Caun

*Attorney, Agent, or Firm*—Eric P. Schellin

[57] ABSTRACT

A waterbed comprises a pedestal which supports decking to which is attached a frame. The frame comprises a back rail, a foot rail, and side rails connected by slotted plates engaging pins which are mounted in corner posts. The frame encompasses a safety liner in which is positioned a water filled mattress. The arrangement of the slotted plates allows the frame to be supported by the decking. In one embodiment, the corner posts do not extend to the floor causing the frame and corner posts to appear to be floating in space.

9 Claims, 7 Drawing Figures

WATERBED FRAME CONSTRUCTION

BACKGROUND OF THE INVENTION

The invention relates generally to waterbeds and more particularly to a waterbed frame utilizing hardware which allows the frame to be assembled quickly, and enables the frame to be supported by a pedestal located beneath the water filled mattress.

A waterbed comprises a pedestal which supports pedestal decking. A waterbed frame is attached to the decking and encompasses a safety liner and a water filled mattress. The frame comprises a back rail, a foot rail, and side rails attached to corner posts. Until the present invention, no satisfactory hardware has been utilized in waterbed frames which would allow a frame to be assembled quickly and without the use of tools. The frame and the hardware used to fasten the frame elements together must be strong enough to withstand the forces to which they will be subjected. Often it is desirable that the corner posts not extend to the floor but that the weight of the waterbed be supported by the pedestal. This type of construction provides a greater distribution of the waterbed's weight. To achieve such ends requires a frame and hardware elements heretofore unknown in the waterbed art.

SUMMARY OF THE INVENTION

It is an object of this invention, therefore to provide a waterbed frame which is supported by a pedestal and is fastened together by hardware which allows such construction.

It is a further object of this invention to provide a waterbed frame surrounding a safety liner and a water filled mattress wherein the frame comprises back, foot, and side rails, and these rails are attached to corner posts by hardware members.

It is another object of this invention to provide a waterbed frame which is simple to assemble and which employs fastening elements enabling the frame to be attached to and supported by a pedestal and pedestal decking.

These and other objects of the invention will be more fully understood from the following description which is given by way of example only.

DESCRIPTION OF THE PREFERRED EMBODIMENT

Figure 1:
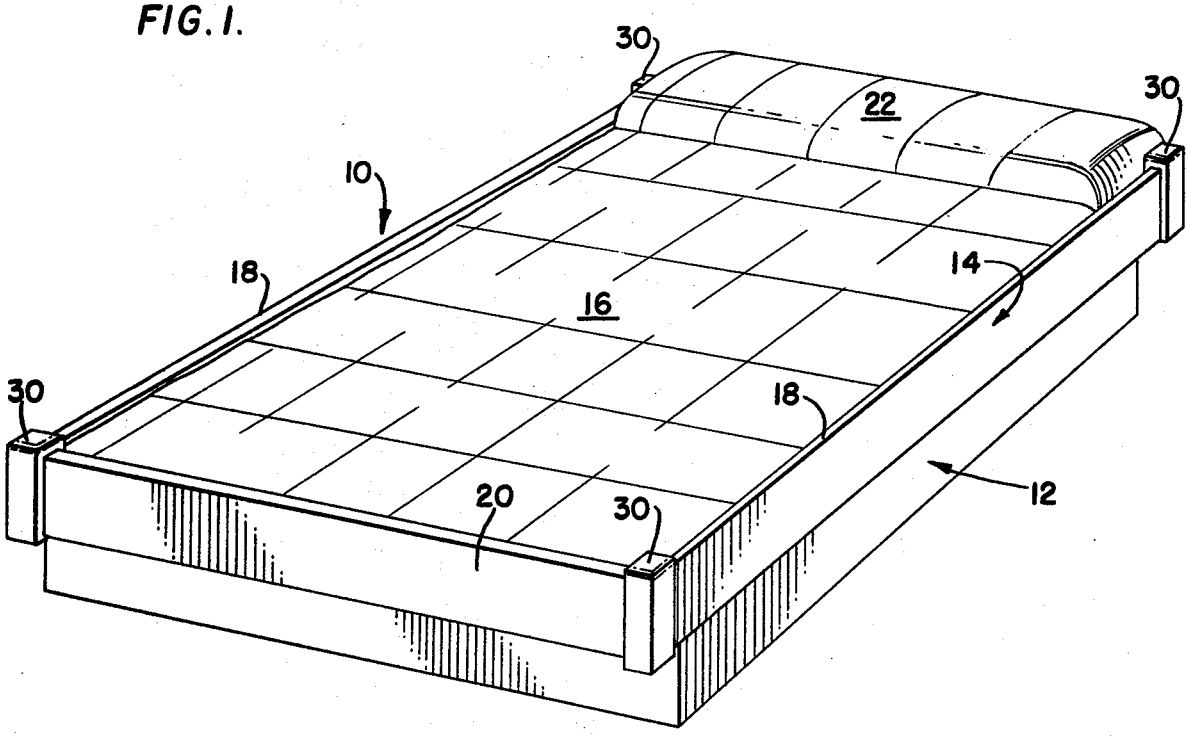
FIG. 1 is a perspective view of a waterbed.

Referring first to FIG. 1 there is shown a waterbed 10 comprising a pedestal 12, a frame 14, and a water filled mattress 16. The frame comprises two side rails 18, a foot rail 20, and a back rail (not visible). For illustrative purposes, a pillow element 22 is shown at the head of the bed.

Figure 2:
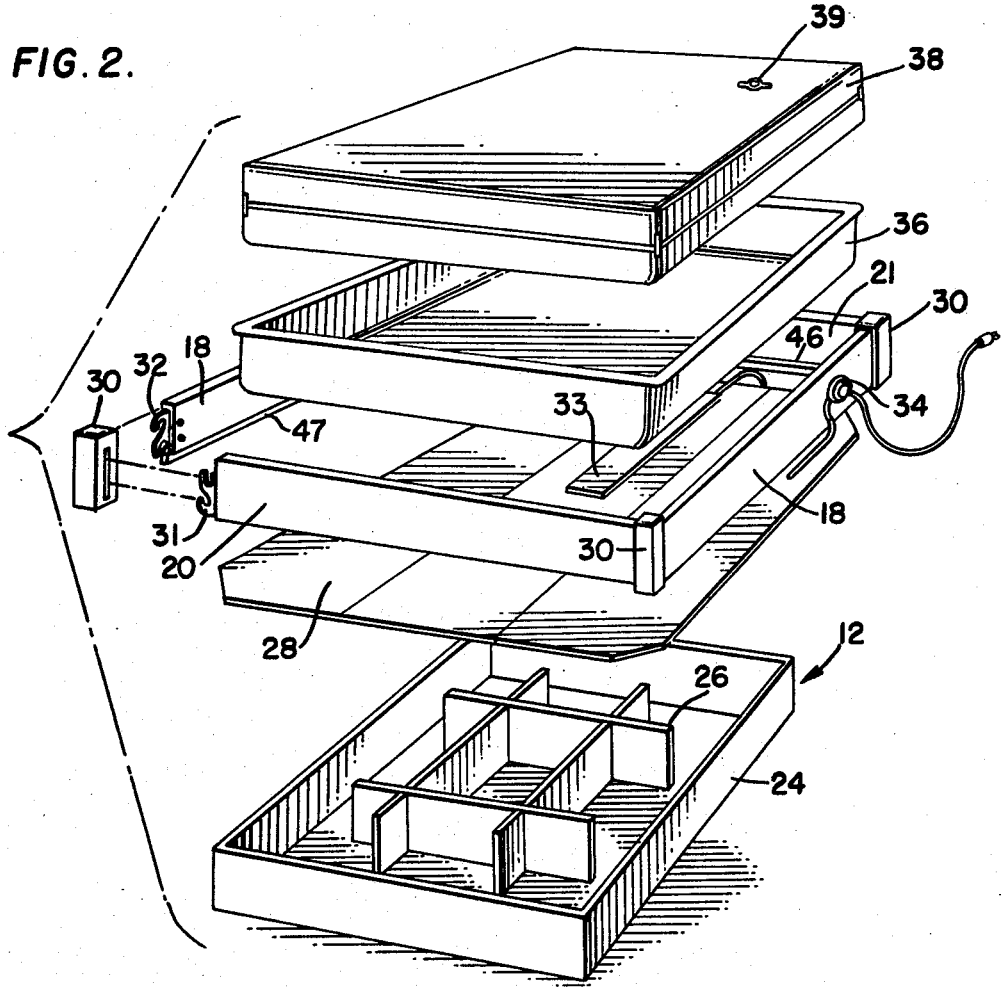
FIG. 2 is an exploded view of a waterbed showing the various component parts thereof.

Turning now to FIG. 2, the various elements of the waterbed are shown with greater particularity. The pedestal 12 is seen as comprising an outer pedestal base 24 and a pedestal insert 26 which is located therein. The elements of the pedestal base and insert are all of equal height to define a plane. The upper surface of the pedestal supports pedestal decking 28. The decking is sized to extend beyond the perimeter of the pedestal base. Both the pedestal and the decking may be constructed of wood, metal, pressed board, or other suitable material which is capable of withstanding the forces which will be applied thereto.

Attached to the decking in a manner to be more fully explained below is the frame 14 which comprises the side rails 18, the foot rail 20, and the back rail 21. Four corner posts 30, three of which are visible, join the frame elements together by means of cooperation with slotted plates 31 and 32. A heater element 33 which is controlled by a thermostat 34 is provided to warm by convection the fluid contained within a fluid impermeable bag comprising mattress 38. The mattress may be filled or emptied by means of valve 39 in a manner which is customary. The mattress 38 is supported by the decking 28. A safety liner 36 of plastic or other waterproof material is interposed between the frame and decking and the water filled mattress to confine the water of the mattress should the mattress develop a leak. The frame may be made of wood, metal, or other suitable material, and the slotted plates may be made of steel.

Figure 3:
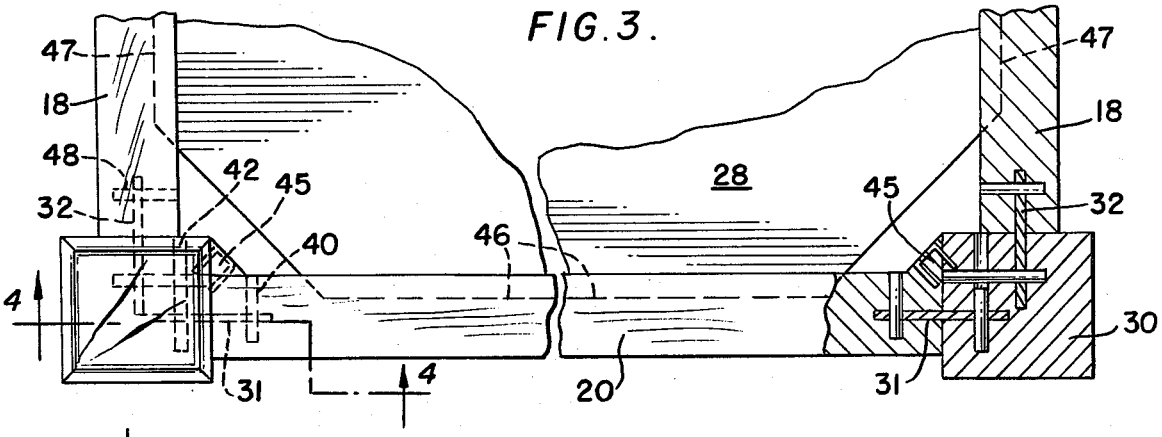
FIG. 3 is a plan view of one end of a waterbed frame and decking members in their assembled relationship.
Figure 4:
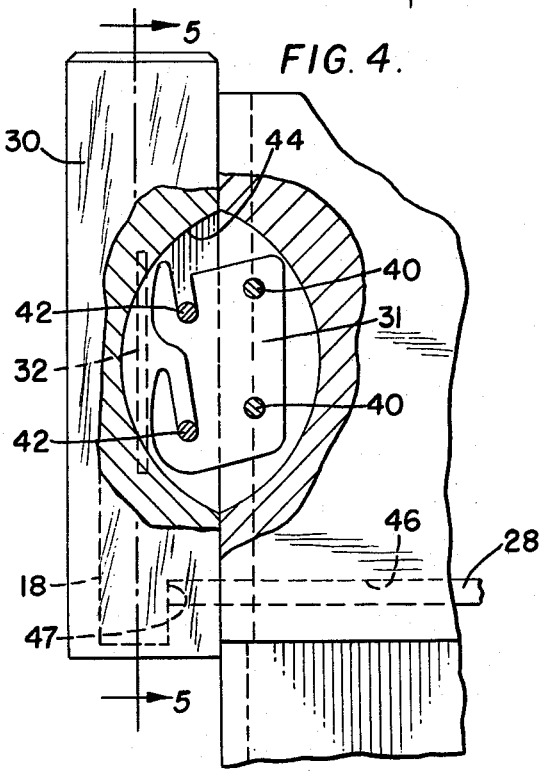
FIG. 4 is a sectional view taken along line 4—4 of FIG. 3 showing the connection between a corner post and a foot or back rail.

Turning now to FIG. 3, the corner construction of the bed frame can be seen in greater detail. The slotted plates 31 are fastened to the foot rail 20 by the steel pins 40. As shown at FIG. 2, the plates 31 are positioned with the open slot ends facing upward. These slots engage steel pins 42 which are set in the corner posts. It will be seen from FIG. 4 that a crescent shaped slot 44 has been formed in the corner post 30 as by a circular saw, and that this crescent slot allows access to the pins 42 from the inside of the corner post. It is contemplated that the corner posts can be factory mounted to the head and foot rails, and that corner gussets 45 can be glued and stapled into place to make this mounting permanent. Of course, the gussets can be eliminated and the mounting of the corner posts to the head and foot rails can be left to the ultimate user.

Figure 5:
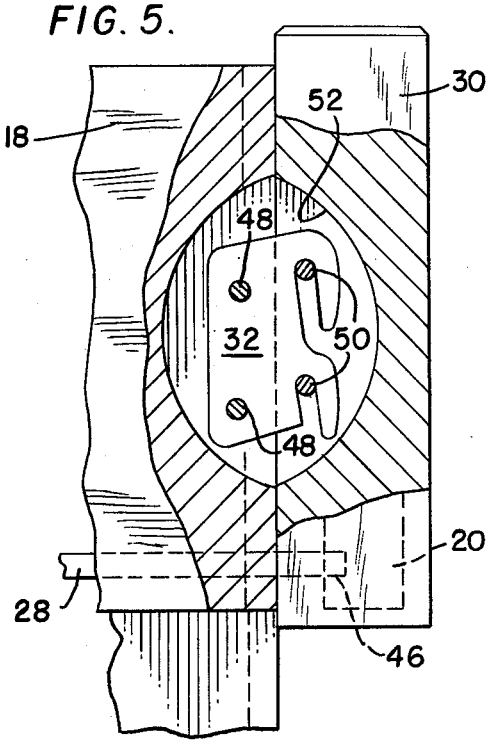
FIG. 5 is a sectional view taken along line 5—5 of FIG. 4 showing the connection between a corner post and a side rail.

Further in FIG. 3, it will be seen that the decking 28 penetrates the foot rail 20 and this is made possible by a rabbet 46 formed along the lower edge thereof. The back rail is similarly rabbetted. A rabbet 47 is formed along the lower edge of the side rails 18. The side rail rabbets differ from those in the back and foot rails in that the entire lower corner of the side rail 18 is removed to form the rabbet 47 while the rabbets 46 in the head and foot rails resemble a groove. To avoid conflict with corner posts 30 and gussets 45, the corners of the decking 28 have been truncated. The slotted plates 32 are fastened to the side rails by pins 48. These plates are mounted with their slots facing downward, as shown in FIG. 5, and these slots engage pins 50 mounted in the corner post 30. Again, a crescent shaped slot 52 is formed in post 30 to enable this engagement. The protrusion of the decking edge into the rabbet 46 of the foot rail can also be seen more clearly in FIG. 5.

The structural cooperation of the various waterbed components and the method of assembly thereof should now be clear. The pedestal base 24 and insert 26 support the pedestal decking 28. The corner posts 30 are fastened to the back and foot rails, 21 and 20 respectively, by the gussets 45. Great strength is achieved in the corner construction by virtue of the pins and slotted plates 31, it being understood that the gussets function only to prevent separation of the corner posts from the head and foot rails. To assemble the frame, the side rails 18 are attached to the corner posts by means of the slotted plates 32. As the plates engage the pins 50, the back rail 21 and the foot rail 20 are drawn together due to the slant of the slots in plates 32. This drawing together causes the pedestal decking 28 to be captured by the rabbets 46 in the back and foot rails, and these rails are supported thereby. The upward slant of the slots of plates 31 enable the weight of the corner posts 30 to be securely supported through the engagement with pins 42. The downward slant of the slots of plates 32 enable the weight of side rails 18 to be carried by the pins 50 in the corner posts 30. The side rails are additionally supported by the decking 28 which engages the upper edge of the rabbet 47 in the side rails. Thus, all elements of the frame are supported by the decking which is in turn resting on the pedestal. After the heater 33 has been positioned on the decking, the liner 36 and the mattress 38 are placed within the frame and the mattress may be filled with water. The pedestal supports the weight of the water filled mattress.

Figure 6:
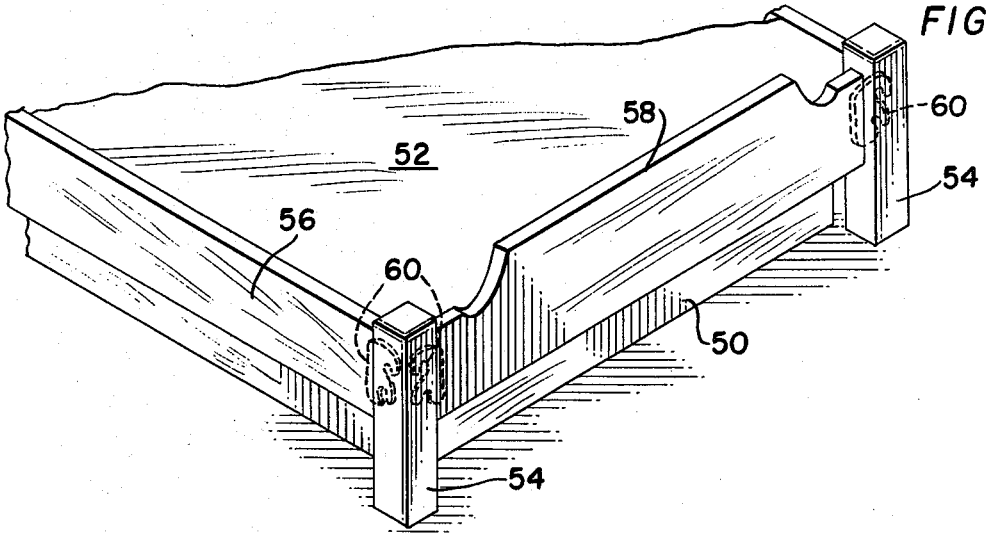
FIG. 6 is a perspective view showing the foot section of an alternate form of waterbed.

FIG. 6 shows an alternative embodiment in which a pedestal 50 is provided to support the weight of a water filled mattress 52. Corner posts 54 extend to the floor and are able to support the weight of side rails 56 and foot rail 58. All rail elements have mounted thereon plates 60 having slots which face downward. While not shown in the drawing, it will be understood that these slots engage pins which are mounted in the corner posts 54. The foot rail and its respective corner posts and the side rail and its respective corner posts (not shown) may be permanently fastened together by means of gussets as described with reference to FIG. 3. The gussets are not essential, however, in which case the rail elements are attached to the corner posts by forcing rails with the slotted plates 60 downward to engage the pins within the posts. When the side rails are attached, the slant of the slots draws the back and foot rails together and the pedestal decking is captured by the rabbetted inside surface of these rails.

Figure 7:
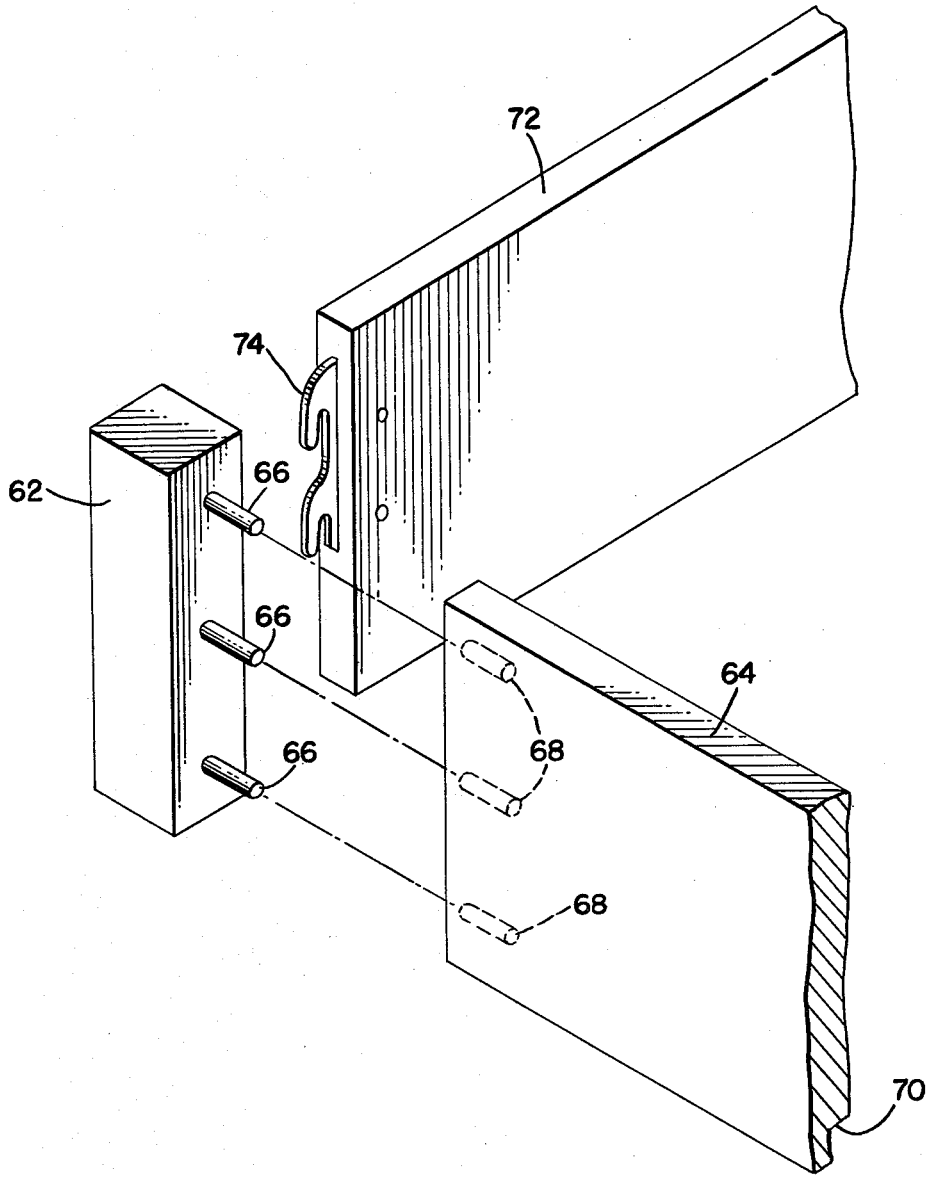
FIG. 7 is a detail view of an alternate form of connection between a corner post and a back rail.

Turning now to FIG. 7, an alternative embodiment is shown in which the corner post 62 is attached to the foot rail 64 by three dowels 66. The dowels 66 which mutually engage the corner post 62 and the rail 64 by means of the pockets 68 are set into place and factory glued so that an ultimate user need only assemble the side rails and back rail thereto to complete a waterbed frame. The foot rail 64 is formed with a rabbet 70. This rabbet allows the foot rail to rest on the edge of the decking (not shown) and to be supported thereby. A back rail (not shown) is constructed in a manner similar to that of the foot rail 64 and is attached to its respective corner posts by dowels. The side rails 72 attaches to the corner post 62 by means of a slotted plate 74 in a manner heretofore described. It will be noticed in this embodiment that the side rail 72 is not rabbetted along the lower edge thereof for receipt of the decking. The side rail therefore receives its support solely from the slotted plate attachment with the corner post.

Having described the invention, various modifications and departures will become apparent to one skilled in the art, which modifications are intended to be within the scope of the invention as defined in the appended claims.

I claim:

1. A bed, said bed comprising:

a water impermeable mattress adapted to be filled with water, a waterproof liner encompassing said mattress on four sides and the bottom thereof, a frame surrounding said liner, said frame comprising a first pair of rail elements, a second pair of rail elements and four corner posts, each corner post containing pins, slotted plates terminating the ends of each of the rail elements whereby the slotted plates engage said pins, a deck supporting said liner, said deck having opposite ends attached to a first pair of said rail elements, said deck supporting said frame, said frame surrounding said deck, and a pedestal supporting said deck, whereby said pedestal provides the sole support for said deck, said frame, said liner, and said mattress.

2. The bed of claim 1, wherein said first pair of rail elements are rabbetted to receive said deck and have slotted plates, the slots of which face upward, and said second pair of rail elements are rabbetted to rest on said deck and have slotted plates, the slots of which face downward.

3. A bed supported by a floor, said bed comprising:

a pedestal resting on and supported by said floor, a decking member resting on and supported by said pedestal, a frame comprising corner posts and side rails, each corner post resting on said floor, a rabbet formed along a lower edge of said side rails for engaging said decking member, said frame surrounding said decking, slotted plates attached to said side rails at the ends thereof and engaging said corner posts, said slotted plates having slots the open ends of which face said floor, a water impermeable liner facing said side rails and said decking, and a water impermeable mattress adapted to be filled with water resting on said liner, the weight of said mattress being supported by said pedestal.

4. A bed comprising:

a mattress comprising a water impermeable bag adapted to be filled with water, a deck supporting said mattress a frame surrounding said mattress and said deck and supported by said deck, and a pedestal supporting said deck, wherein, said frame comprises a first pair of opposing rail elements attached to first opposite sides of said deck, said first pair of opposing rail elements each including rabbet means along a lower edge thereof for receiving opposite ends of said deck, a second pair of opposing rail elements bordering opposite sides of said deck, the first and second pair of opposing rail elements forming a rectangle, four corner posts, dowel means attached to said corner posts and engaging either end of said first pair of opposing rail elements, and fastening means attached to either end of said second pair of opposing rail elements and engaging said corner posts, said fastening means include slotted plates, the slots of said plates being angled to draw said corner posts and first opposing rail elements toward one another whereby said deck is captured by said rabbet means and said deck supports said first opposing rail elements.

5. The bed of claim 4, wherein said corner posts are supported solely by said dowel means and the slots of said slotted plates are angled downward whereby the second pair of opposing rail elements are supported solely by said corner posts.

6. The bed of claim 4, wherein said corner posts are supported solely by said dowel means, and the second pair of opposing rail elements include rabbet means for engaging said deck and receiving support therefrom.

7. A bed supported by a floor, said bed comprising:

a pedestal resting on and supported by said floor, a decking member resting on and supported by said pedestal, a frame comprising a first and second pair of opposing rail elements and four corner posts, each corner post resting on said floor, fastening means attaching the ends of said rail elements to said corner posts, said fastening means including dowel means, rabbet means formed along the lower edge of said first pair of opposing rail elements for engaging said decking member, a water impermeable liner supported by said decking and facing said rail elements and said decking, and a water impermeable mattress adapted to be filled with water resting on said liner, the weight of said mattress being supported by said pedestal.

8. A bed comprising:

a mattress comprising a water impermeable bag adapted to be filled with water, a rectangular deck supporting said mattress, a frame surrounding said mattress and said deck and supported by said deck, said frame comprising a first pair of opposing rail elements attached to first opposite sides of said deck, said rail elements being rabbetted to receive opposite ends of said deck, a second pair of opposing rail elements bordering second opposite sides of said deck, said first and second pair of opposing rail elements forming a rectangle, four corner posts, first slotted plates attached to either end of said first pair of opposing rail elements and engaging said corner posts, the slots of said first plates facing upward, and second slotted plates attached to either end of said second pair of opposing rail elements and engaging said corner posts, the slots of said second plates facing downward and being angles to draw said corner posts with attached first opposing rail elements toward one another whereby said deck is captured by said rabbets.

9. The bed of claim 8, wherein said second pair of opposing rail elements are rabbetted and receive support from said deck.

* * * * *